US007757912B1

(12) United States Patent
Fabro

(10) Patent No.: US 7,757,912 B1
(45) Date of Patent: Jul. 20, 2010

(54) SPORTS BACKPACK

(76) Inventor: Eliseo Fabro, 10065 Sycamore Canyon Rd., Moreno Valley, CA (US) 92557

( * ) Notice: Subject to any disclaimer, the term of this patent is extended or adjusted under 35 U.S.C. 154(b) by 1068 days.

(21) Appl. No.: 11/405,973

(22) Filed: Apr. 17, 2006

Related U.S. Application Data

(60) Provisional application No. 60/671,671, filed on Apr. 15, 2005.

(51) Int. Cl.
*A45F 4/02* (2006.01)

(52) U.S. Cl. ..... 224/155; 224/153; 224/650; 224/627; 297/129; 297/17; 297/130

(58) Field of Classification Search ..... 224/155, 224/153, 650, 677, 255, 256, 271, 249; 297/129, 297/17, 130; 403/252–255, 331, 353
See application file for complete search history.

(56) References Cited

U.S. PATENT DOCUMENTS

| | | | | |
|---|---|---|---|---|
| 4,530,451 | A * | 7/1985 | Hamilton | 224/155 |
| 4,723,695 | A * | 2/1988 | Farber | 224/153 |
| 5,230,450 | A * | 7/1993 | Mahvi et al. | 224/153 |
| 5,819,999 | A * | 10/1998 | Tennant | 224/155 |
| 5,957,349 | A * | 9/1999 | Krulik | 224/155 |
| 6,336,577 | B1 * | 1/2002 | Harris et al. | 224/153 |
| 6,375,258 | B1 * | 4/2002 | Fang | 297/188.08 |
| 6,997,507 | B2 * | 2/2006 | Rhee | 297/129 |

* cited by examiner

*Primary Examiner*—Nathan J Newhouse
*Assistant Examiner*—Peter Helvey
(74) *Attorney, Agent, or Firm*—Kenneth L Tolar

(57) ABSTRACT

A sports backpack includes a hollow bag member with a pair of shoulder straps on the front surface thereof for securing the bag member to a user's back. The bag member includes several storage compartments that are accessible with zippers. Furthermore, the bag member includes a plurality of horizontally aligned male snap members on the rear surface thereof. An accompanying collapsible stool includes an attachment strip with mating female snap members thereon for fastening the stool to the bag member.

5 Claims, 2 Drawing Sheets

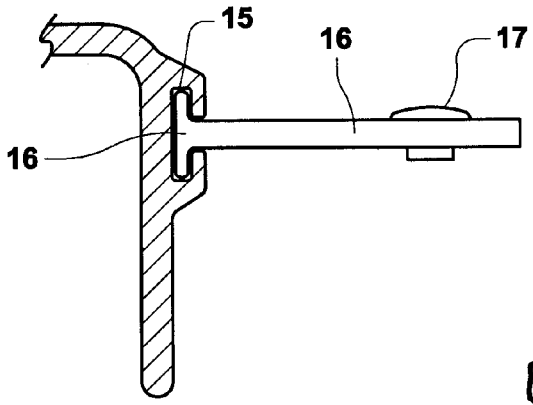
FIG. 4
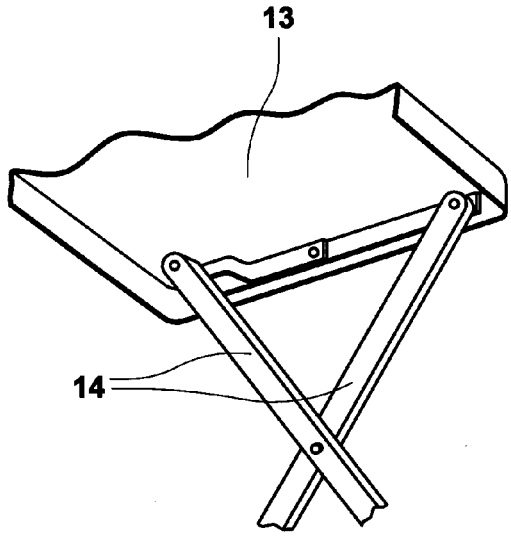
FIG. 5
FIG. 6
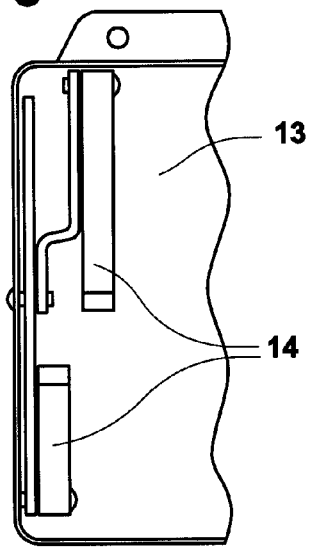
FIG. 7
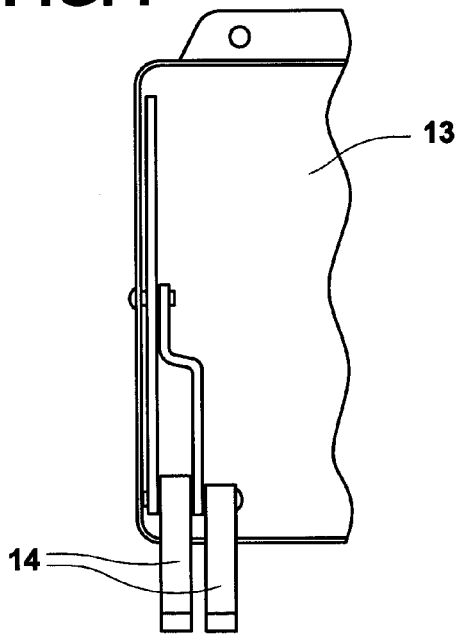

SPORTS BACKPACK

CROSS REFERENCE TO RELATED APPLICATIONS

This application is entitled to the benefit of provisional application No. 60/671,671 filed on Apr. 15, 2005, the specification of which is incorporated herein by reference.

BACKGROUND OF THE INVENTION

The present invention relates to a backpack designed particularly for spectator events where adequate seating may not be available.

DESCRIPTION OF THE PRIOR ART

When attending certain events, such as a child's athletic contest, a spectator must often transport multiple items such as beverage containers, food items, clothing and similar accessories. Additionally, because the seating at such events is often inadequate, a temporary chair may also be necessary. Transporting these items to and from a spectator event is always cumbersome and inconvenient. Accordingly, there is currently a need for a device that assists a user with transporting multiple items to a sporting event. The present invention addresses this problem by providing a uniquely designed backpack having a portable stool detachably connected thereto.

SUMMARY OF THE INVENTION

The present invention relates to a sports backpack including a hollow bag member with a pair of shoulder straps on the front surface thereof for securing the bag member to a user's back. The bag member includes several storage compartments that are accessible with zippers. Furthermore, the bag member includes a plurality of horizontally aligned male snap members on the rear surface thereof. An accompanying collapsible stool includes an attachment strip with mating female snap members thereon for fastening the stool to the bag member.

It is therefore an object of the present invention to provide a sports backpack that allows a user to transport multiple accessories to a spectator event.

It is another object of the present invention to provide a sports backpack having a detachable stool secured thereto for providing a user with temporary seating.

Other objects, features, and advantages of the present invention will become readily apparent from the following detailed description of the preferred embodiment when considered with the attached drawings and the appended claims.

BRIEF DESCRIPTION OF THE DRAWINGS

FIG. 4 is a detailed view of the attachment strip for securing the accompanying stool to the bag member.

FIG. 5 depicts the underside of the stool with the support legs in an expanded orientation.

FIG. 6 is a partial cutaway view of the underside of the stool with the legs in a stowed configuration.

FIG. 7 is a partial cutaway view of the underside of the stool with the legs extended and positioned in a contiguous relationship for transport on the backpack.

DESCRIPTION OF THE PREFERRED EMBODIMENT

Figure 1:
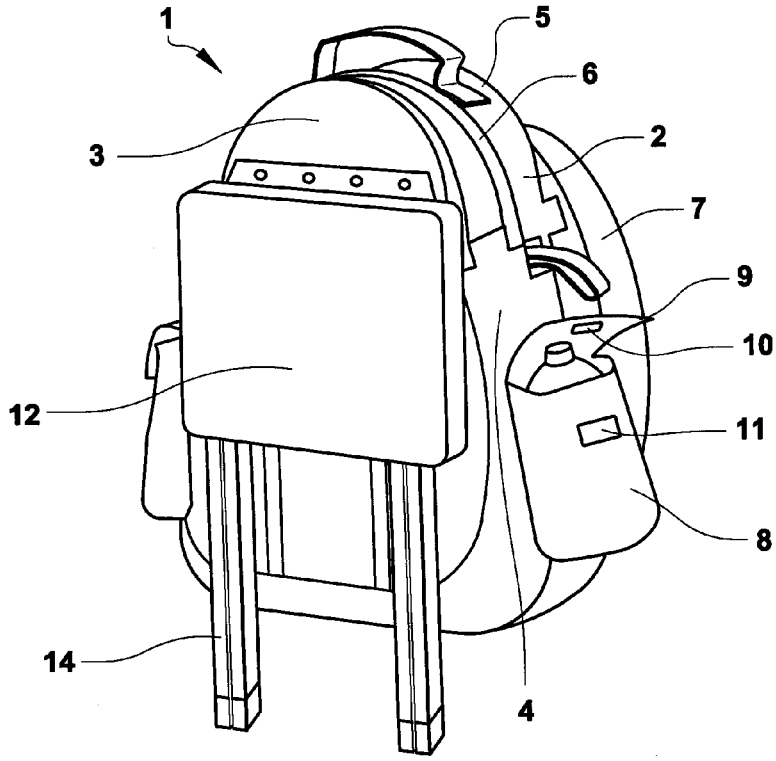
FIG. 1 is a perspective view of the sports backpack according to the present invention.
Figure 2:
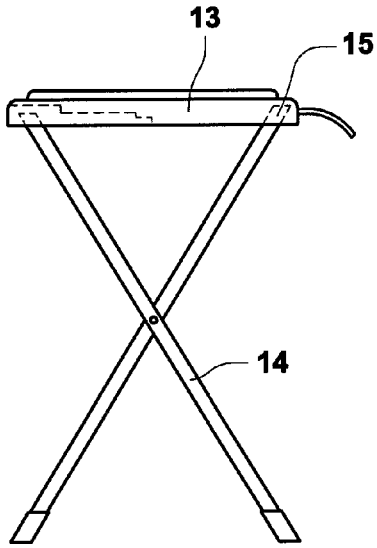
FIG. 2 is a side view of the detachable stool according to the present invention.
Figure 3:
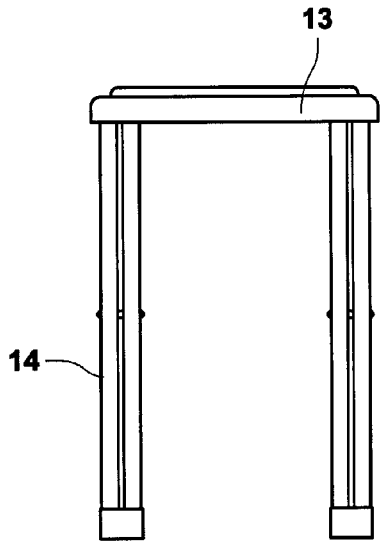
FIG. 3 is a front view of the detachable stool.

The present invention relates to a sports backpack. The device comprises a hollow bag member 1 having a front surface 2, a rear surface 3, two opposing sides 4, an upper end 5 and a lower end. The bag member includes multiple zippers 6 that each provide access to an interior storage compartment.

On the front surface are a pair of padded shoulder straps 7 for securing the bag member to a user's back. On each side of the bag member is a cylindrical beverage container receptacle 8 with an enclosing flap 9 adjacent thereto. The flap includes a hook and loop fastener 10 on a side thereof for adhering to a mating fastener 11 on the receptacle exterior to secure a beverage container therein.

On the rear surface of the bag member are a plurality of horizontally aligned male snaps. The device also includes a collapsible stool 12 having a seat member 13 with support legs 14 pivotally attached to the underside thereof. The legs are secured with conventional hardware that locks the legs in a collapsed or deployed configuration. A channel 15 is formed on an edge of the seat member that slidably receives an attachment strip 16. The attachment strip includes a plurality of female snap members 17 for mating engagement with the male snap members on the bag member to secure the stool thereto.

The above described device is not limited to the exact details of construction and enumeration of parts provided herein. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A sports backpack comprising:

a hollow bag member having a front surface, a rear surface, two opposing sides, an upper end and a lower end;

a plurality of horizontally-aligned snaps on the rear surface of the bag member;

a collapsible stool removably secured to said bag member, said stool including a seat member having a lower surface and at least one edge;

a channel formed on the edge of said seat member;

a plurality of collapsible support legs depending from said seat member;

an attachment strip slidably received within said channel, said strip having a plurality of snaps longitudinally positioned thereon for mating engagement with said snaps on said bag member.

2. The sports backpack according to claim 1 further comprising multiple zippers on said bag member, each of said zippers providing selective access to an interior storage compartment.

3. The backpack according to claim 2 further comprising a pair of padded shoulder straps on the front surface of said bag member for securing said bag member to a user's back.

4. The backpack according to claim 3 further comprising a cylindrical beverage container receptacle on each of the two opposing sides of the bag member.

5. The backpack according to claim 4 wherein each receptacle includes an enclosing flap adjacent thereto, said flap having a hook and loop fastener on a side thereof for adhering to a mating fastener on the receptacle exterior to secure a beverage container therein.

* * * * *